United States Patent [19]

Schoppe

[11] 4,057,021

[45] Nov. 8, 1977

[54] COMBUSTION OF PULVERIZED COAL

[76] Inventor: Fritz Schoppe, Max-Ruttgers-Strasse 24, 8026 Ebenhausen, Isartal, Germany

[21] Appl. No.: 698,301

[22] Filed: June 21, 1976

[30] Foreign Application Priority Data

June 20, 1975 Germany ..... 2527618

[51] Int. Cl.[2] ..... F23D 11/44; F23D 1/00; F23R 1/14

[52] U.S. Cl. ..... 110/28 A; 431/2; 431/11

[58] Field of Search ..... 110/28 R, 28 A, 28 B, 110/28 D; 431/2, 11, 159, 350

[56] References Cited

U.S. PATENT DOCUMENTS

| | | | |
|---|---|---|---|
| 3,171,388 | 3/1965 | Ganz | 122/149 |
| 3,250,236 | 5/1966 | Zelinski | 110/28 A |
| 3,400,921 | 9/1968 | Hemker | 110/28 D |
| 3,460,519 | 8/1969 | Ospelt et al. | 122/149 |
| 3,856,455 | 12/1974 | Otway et al. | 431/11 |

*Primary Examiner*—Kenneth W. Sprague

[57] ABSTRACT

This invention relates to a process and apparatus for the combustion of pulverized coal, wherein the pulverized coal is introduced into a conditioned atmosphere having an overpressure, the overpressure being used to accelerate a flame jet, and wherein the flame jet is injected into an atmosphere having a temperature below the ash melting temperature of the fired coal.

36 Claims, 8 Drawing Figures

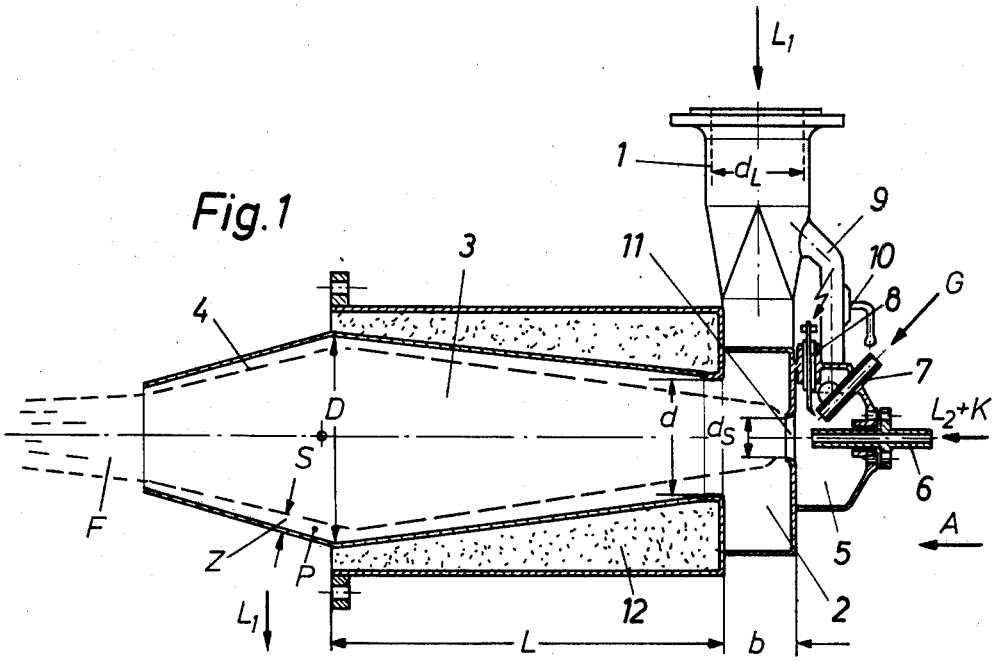
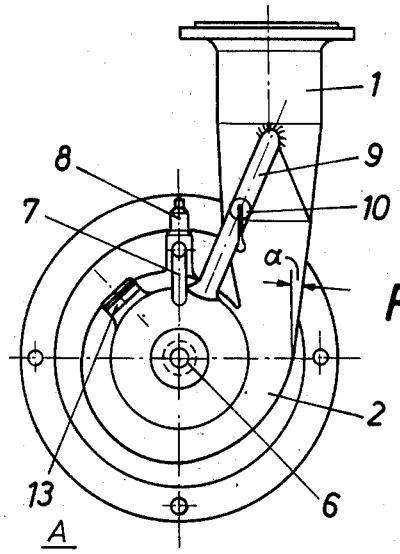
Fig.2
Fig.3
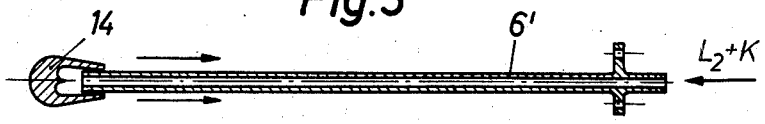

A - B

A - B

COMBUSTION OF PULVERIZED COAL

BACKGROUND OF THE INVENTION

This invention relates to the combustion of pulverized coal in particular for slowly reacting coal like anthracite, lean coal etc. with a volumetric heat release rate corresponding to the flame volume of more than 2 million Kcal/m³.h.at.

Different types of designs for coal-dust firing have been known for a long time. They are divided into those with dry ash removal and those with liquid ash removal. Dry ash removal is usually employed with coal high in inerts, especially brown coal, in order to profit by the heat content of the ash in the boiler flue passes.

Dry ash removal requires sufficiently low furnace temperatures. These are usually achieved by the corresponding volumetric heat release rate. In this case there are volumetric heat release rates of 100,000 to 200,000 Kcal/m³.h.at. This again means an accordingly large volume of the radiation chamber and, accordingly, a large boiler volume. The low furnace temperatures lead to partially poor combustion. This again has led to more or less complicated methods for recycling unburnt ashes.

High volumetric heat release rates in boilers fired by pulverized coal can only be achieved with so-called "wet bottom" boilers up to now. In this case there are volumetric heat release rates of the order of 1 million Kcal/m³.h.at and more when operating with liquid slag. In certain areas of the combustion chamber they consciously put up with the fact that part of the heating surface is covered with more or less molten slag. No doubt this permits the design of accordingly smaller boilers because of the higher volumetric heat release rates and of the smaller combustion chamber. Because of the necessity of maintaining high temperatures however, wet bottom boilers are not fit for the firing of small amounts of pulverized coal. In particular, wet bottom boilers do not permit the ON/OFF control usually preferred in central heating control technology as it would result in the solidification of the slag flow at every boiler stop.

SUMMARY OF THE INVENTION

The invention under consideration is directed to the problem of designing a method for the combustion of pulverized coal, in particular of low-reactivity pulverized coal, whereby it yields dry ash removal in spite of high volumetric heat release rates of more than 2 million Kcal/m³.h.at., so that its application for the firing of central heating facilities with "ON/OFF" control becomes possible.

According to the invention, this problem is solved as follows:

The pulverized coal is introduced into an atmosphere in which the following conditions exist:

a. Overpressure compared to the chamber to be fired, at least 20 mm WG (water, gauge) for a boiler capacity of 250,000 Kcal/h;
b. $O_2$ contents below 10%, preferably below 5%;
c. Temperature high enough so that the pulverized coal is heated at a rate of at least 1000° C/sec up to a temperature of at least 100° to 150° C above its ignition temperature.

The heated pulverized coal is mixed with a gaseous mixture containing mainly combustion air in order to initiate the combustion.

After burning of at least 30%, preferably 50%, of the calorific value, the burning flame jet is accelerated by transformation of the overpressure [(see (a)] into velocity.

The accelerated, still burning flame jet is injected into a gas combustion having a temperature below the ash melting temperature of the fired coal.

The overpressure of the atmosphere into which the pulverized coal is introduced compared to the chamber which is to be fired, is designed to generate a flame jet.

The $O_2$-content of this atmosphere, which is less than 10%, is kept this low so that the pulverized coal is heated without pre-ignition. The temperature of this said atmosphere is high enough so that the pulverized coal is heated to a temperature of 100° C to 150° C above its ignition temperature. In this way the pulverized coal ignites by itself when it mixes with the combustion air. The heating velocity of more than 1000° C/sec causes the pulverized coal to ignite rapidly. Presumably the reason for this is that the vapor pressure in a coal particle rises faster than the vapor can escape out of the coal particle, and thereby the crystalline structure of the coal particle is partially disrupted. As a consequence there remain free valences present on the surface of the coal particle which produce a high surface activity.

The atmosphere into which the accelerated, still burning flame jet is injected consists of recirculated, cool flue gases of the flame jet. The cooling of the flue gases is caused totally or partially by convection, which is produced by the injector action of the flame jet. It is advantageous to surround the flame jet by a cold gas flow, the temperature and/or thickness and/or velocity of which have been so selected that the coal particles which are flung out of the flame jet at the side are cooled down below the ash melting temperature. In this way the dry ash removal is secured in any case.

The overpressure of the atmosphere into which the pulverized coal is introduced is at least 20 mm WG in relation to a boiler capacity of 250,000 Kcal/h. With other boiler capacities this overpressure varies porportionally with the square root of the capacity ratio.

The important advantage of this invention compared to the conventional coal fired boilers, is that fire tube boilers (hereafter also called flame tube boilers or fire boxes) can also be fired due to the dry ash removal. Furthermore, very small amounts of coal can be fired, especially in the capacity range used for hot water and steam boilers for domestic heating. According to the invention this design makes the firing of coal with good ignition characteristics possible, as for instance brown coal or gas coal, as well as the firing of coal with very bad ignition characteristics such as anthracite and coke. According to the invention this kind of combustion makes "ON/OFF" control possible, as it is customary when firing oil or gas. Hence this method is similar to the heating of one-family houses and multiple dwellings. It also makes the design of devices possible which carry out the method at which the pulverized coal feeding means of the burner can be exchanged for gas or liquid fuel feeding means, so that the boiler in the heating system can be converted easily to all kinds of fuels.

A device to carry out the method according to the invention consists of a combustion chamber with a heat transfer surface, a combustor which opens conically towards the boiler, with tangential feeding means for a gaseous mixture containing combustion air, and an axial feeding device for pulverized coal, as well as an acceleration nozzle leading to the combustion chamber, which adjoins at the largest cross-section of the combustor. To carry out the method according to the invention, this device, at a boiler capacity of 200,000 to 250,000 Kcal/h and a pressure loss or pressure drop of combustion air through the combustor of 100 mm WG, is designed so that the tangential spiral angle of the combustion air flow against the circumference is 7° to 10°; the axial length of the spiral is about 85 mm; the combustor has an intake diameter of about 145 mm, an outlet diameter of about 290 mm and a length of about 560 mm, and so that the feeding pipe for the combustion air has a diameter of about 300 mm.

With these figures, a corresponding device can be designed for any other boiler capacity, and such corresponding devices are within the scope of the invention. For boiler capacities which are different from those mentioned above, the various dimensions — with the exception of the tangential spiral angle — are to be varied proportionally with the square root of the capacity ratio.

BRIEF DESCRIPTION OF THE DRAWINGS

The invention, its functioning as well as the design to carry out the method according to the invention will become more clearly understood from the following detailed description of the embodiments and with reference to the accompanying drawings in which:

FIG. 1 is a longitudinal cross-sectional view through a device according to the invention to carry out the method according to the invention;

FIG. 2 is a view from the right of the device according to FIG. 1;

FIG. 3 is a cross-sectional view of a special design for an injection tube for pulverized coal for a device according to FIGS. 1 and 2;

Figure 5:
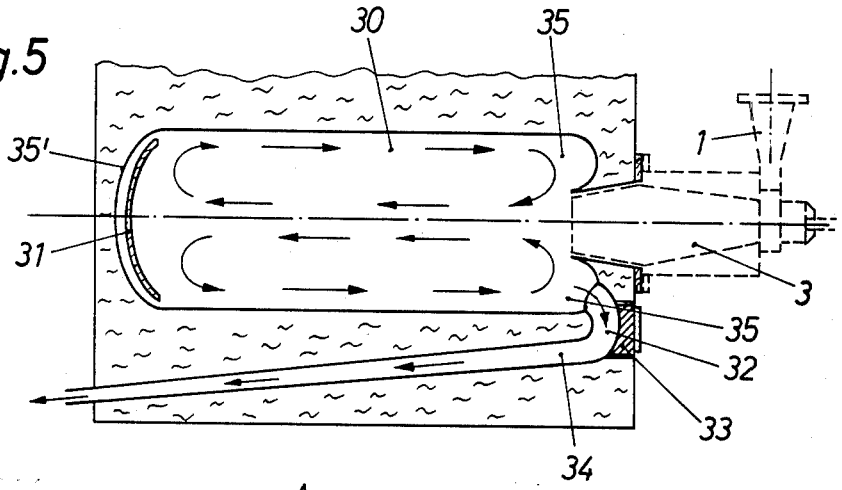
FIG. 5 shows in cross-section a fire tube for pulverized coal firing according to the invention.
Figure 6:
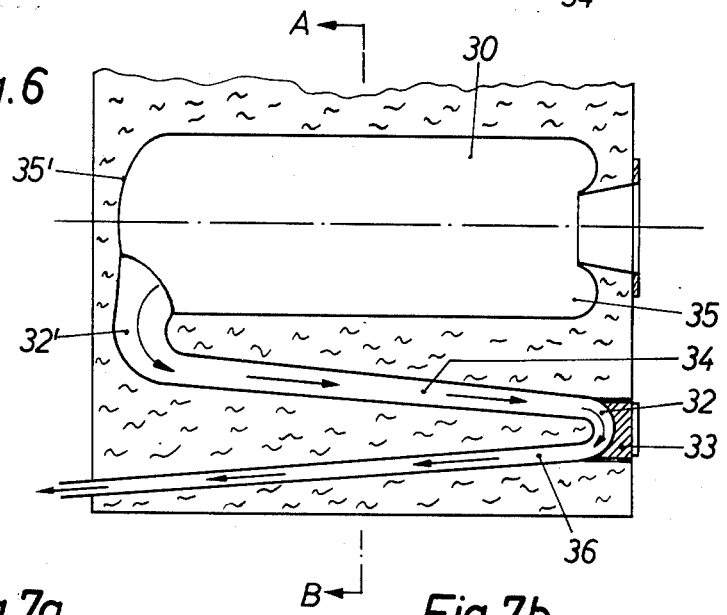
FIG. 6 depicts in cross-section a modified design of a fire tube.

FIGS. *7a* and *7b* show cross-sections through a boiler with fire tubes according to FIGS. 5 and 6 in reduced scale.

DETAILED DESCRIPTION OF THE DRAWINGS

The device according to FIG. 1, hereinafter called pulverized coal burner, consists of an air intake 1 for the combustion air $L_1$, which is given an exactly measured rotation by an air intake 2, which will be discussed hereinafter. This intake 2, which shall be called intake spiral 2, is connected coaxially to a combustor 3, which is preferably divergent, said combustor ending in a convergent coaxial acceleration nozzle 4. The combustor 3 need not be divergent; a cylindrical combustor would also function.

On the intake side of the combustor 3, a head chamber 5 is added coaxially to intake spiral 2, into which a feeding mechanism 6, in the form of an injection tube, is also projected coaxially. Ignition gas G is injected by means of gas tube 7, and is ignited by means of an ignition electrode 8 located at the head chamber.

A small part of the combustion air which enters through the head air conduit 9 flows through the head chamber 5 and the head air valve 10. Head chamber 5 is connected with the intake spiral 2 by means of a central injection opening 11, the edge of which is preferably inclined nozzle-like towards the intake spiral 2. Combustor 3 is surrounded by refractory lining 12. View port 13 permits observation of the ignition process.

Combustion air $L_1$ is fed into the device in order to start the device. A rotation is imparted to the air in the usual way by the intake spiral 2; this rotation causes a vacuum in the center of the intake spiral 2. As a result of the rotation the combustion air moves along a helicoidal path with a flow angle of about 45° towards the surface line of the combustor 3 to the end of the combustor lying opposite the intake spiral 2. Because of the mentioned vacuum in the center of the intake spiral, about half of the combustion air turns radially inward to the axis of the combustor and flows back to intake spiral 2 along the axis of combustor 3. Here the backflow spreads apart radially and joins the now entering combustion air $L_1$ in order to flow together with the entering air $L_1$ to the end of the combustor 3 lying opposite the intake spiral 2. Thus, the air flow is overlaid by an intensive recirculation, which is characterised by the fact that the components of the said air flow and the said back flow touch frictionally on a line whose length is great in comparison to the thickness of the friction zone. It is known that by these means a very intensive intermixing of both currents takes place. That part of the current which is not recirculating leaves combustor 3 by means of an acceleration nozzle 4 which is placed at the end of the combustor 3. A stagnation point S, clearly visible from outside, develops between the part of the flow leaving the nozzle 4 and the backflow.

Pilot gas G is injected by a gas tube 7 and is ignited by the sparks of the ignition electrode 8. The velocity of the igniting gas G is so calibrated that a flame is produced similar to that of a Bunsen burner, which begins at the outlet diameter of the gas tube 7 and reaches through the injection opening 11 into the injection tube 6 by means of the carrier air $L_2$. The pulverized coal ignites at once when contacting the previously mentioned pilot flame. Through its momentum it is carried into the combustor 3 and there it is intermixed with the combustion air $L_1$ by means of the described flow pattern. The pilot gas flow G can then be turned off.

A flame F is formed in the combustor 3 which fills the combustor 3 and acceleration nozzle 4 completely with the exception of a cold air zone Z adjacent to the wall. The surface of the flame F is approximately indicated in FIG. 1. Owing to the difference in density between the cold combustion air and the hot flame gas, the flame F has a very smooth surface and remains well separated from the walls of the combustor 3 and the accelaration nozzle 4. As a result the walls stay relatively cool. Their temperature is the equilibrium between the flame radiation and the heat flow of the fast flowing combustion air of the cold air zone.

Now if a pulverized coal particle, which is burning and possibly carrying some amount of molten ash, is hurled out of the flame F into the cold air zone Z, as a result of the rotation of the combustion air, it is burnt out surprisingly rapidly, as experiments have shown, because of the abrupt and intensified oxygen supply. The relatively little remaining ash cools off so quickly in the rapid cold air flow that it is no longer adhesive when it reaches the walls of combustor 3 or acceleration nozzle 4. Even though there are combustion temperatures of between 1400° and 1600° C at the interior of the flame F, the inner walls of combustor 3 and acceleration nozzle 4 stay clean and free of slag deposits of any sort. Thereby they attain an appropriately long service life.

The calibration of the air flow which enters the head chamber 5 through the head air conduit 9 is of considerable practical advantage and can be secured by a single adjustment of the head air valve 10. The momentum of the axial backflow in the combustor 3 is so great that burning coal particles are blown into the head chamber through the injection opening 11, thereby soiling it. The larger the air flow injected into the head chamber 5, the further the flame is pressed downstream into the combustor 3, a fact that can be observed through the viewport 13. It is advisable to adjust the amount of head air with the head air valve 10 at an air and coal flow rate such that the flame is just visible at the injection opening 11 seen in FIG. 1. Surprisingly, experience has shown that the flame retains this position and form over a sufficient range of flow rates and of adjustments. The adjustment is quite simple and can be regulated by anyone skilled in the art.

The residence time of the coal particle in the combustor 3 can be raised by means of constructive measures in very small combustors and/or kinds of coal with very bad ignition quality as shown in FIG. 3. The injection tube 6' in this embodiment extends approximately to the stagnation point S which is seen in FIG. 1. A return cap 14 has been put on the injection tube 6' which deflects the carrier air flow $L_2$ and the hereby transported pulverized coal K by 180° and brings it with the return current along the axis of the combustor 3 in the direction of the intake spiral 2. On the way along the axis of combustor 3 the coal particles are exposed to intensive radiation by the flame F which surrounds it, and ignite by themselves, even with small burner sizes. The injection tube 6' and the return cap 14, as well as parts of the combustor 3 and of the acceleration nozzle 4, are made of the usual heat-resistant nickel-chromium steel. Experiments and experience have surprisingly shown that the cooling effect of the air velocity in the cold air zone Z and of the carrier air $L_2$ is so great that these parts are still in good condition even after long use and in large burners with high temperatures. The cold air flow, originally assigned according to the invention to cool off coal particles P which have been hurled out, also causes a corresponding working life of the parts which are exposed to the flame radiation. The acceleration nozzle 4 is essential for the cooling of the ash together with its conversion from the molten to the solid state. Of course it is possible to obtain a dry ash removal without the described procedure when using a sufficiently oversized combustion chamber. But the acceleration nozzle causes, according to the invention, an increased combustion efficiency, a uniformity of heat flux along the heating surface of the firing chamber, and a reduction of the required firing chamber dimensions. It works as follows:

The momentum of the jet of the flame F, which leaves the outlet cross-section of the acceleration nozzle 4, acts as injector and accelerates the gas volume of the combustion chamber, with which it is surrounded. Thereby a recirculation of gas is initiated in the combustion chamber. The burner can be placed either coaxially or eccentrically to the axis line of the fire tube. The coaxial arrangement produces the most uniform distribution of density of heat flux over the heating surface of the combustion chamber, as approximately demonstrated in FIG. 4. As a result the hot gases of flame F flow away from the burner in the direction of the axis line of the fire tube, and, according to the design of the fire tube, turn back completely or partially at its end and flow towards the burner along the fire tube walls. In this place they turn radially inwards — carried along by the flame momentum — so that the gases, which have been cooled by direct touch with the fire tube walls, now surround the outer zones of flame F. An intense turbulence is produced anew in the contact zone by the great difference in velocity between flame F and the said cooled gases, which not only secures the final combustion of the flame, but also mixes these with the cold gases after a certain length of path. Before reaching the end of the flame tube the gases have sufficiently cooled down so that the molten ash particles in the flame F become solid.

The flame tube should here preferably have a length of two or three fire tube diameters. If it is much shorter, there is a possibility that the mixing of the flame with the recirculating gases will not reach the point where the ash is transformed into a solid state. Such critical cases can be ameliorated, according to the invention, by placing a screen of heat-resistant material on the fire tube bottom, opposite the burner.

A minimum of flame momentum is essential to obtain the cooling effect. It must be sufficient to overcome the forces of buoyancy in the combustion chamber, and to assure a well-controlled recirculation. As experiments have shown, the velocity head of the jet of the flame F in the outlet cross-section of the acceleration nozzle 4 must be at least 10 times larger than the forces of buoyancy per unit area of the flame surface. The velocity head of the flame jet is equal to half the density and the square of velocity of the hot gases in the outlet of the acceleration nozzle 4, while the buoyancy forces can also be determined in the usual way from the difference of specific gravity of hot flame gases and the cold gases of the combustion chamber surrounding them, multiplied by the distance from the flame surface to the above lying wall of the combustion chamber, as is well-known in aerodynamics. The velocity head then has to be at least ten times the forces of buoyancy per unit area.

Figure 4:
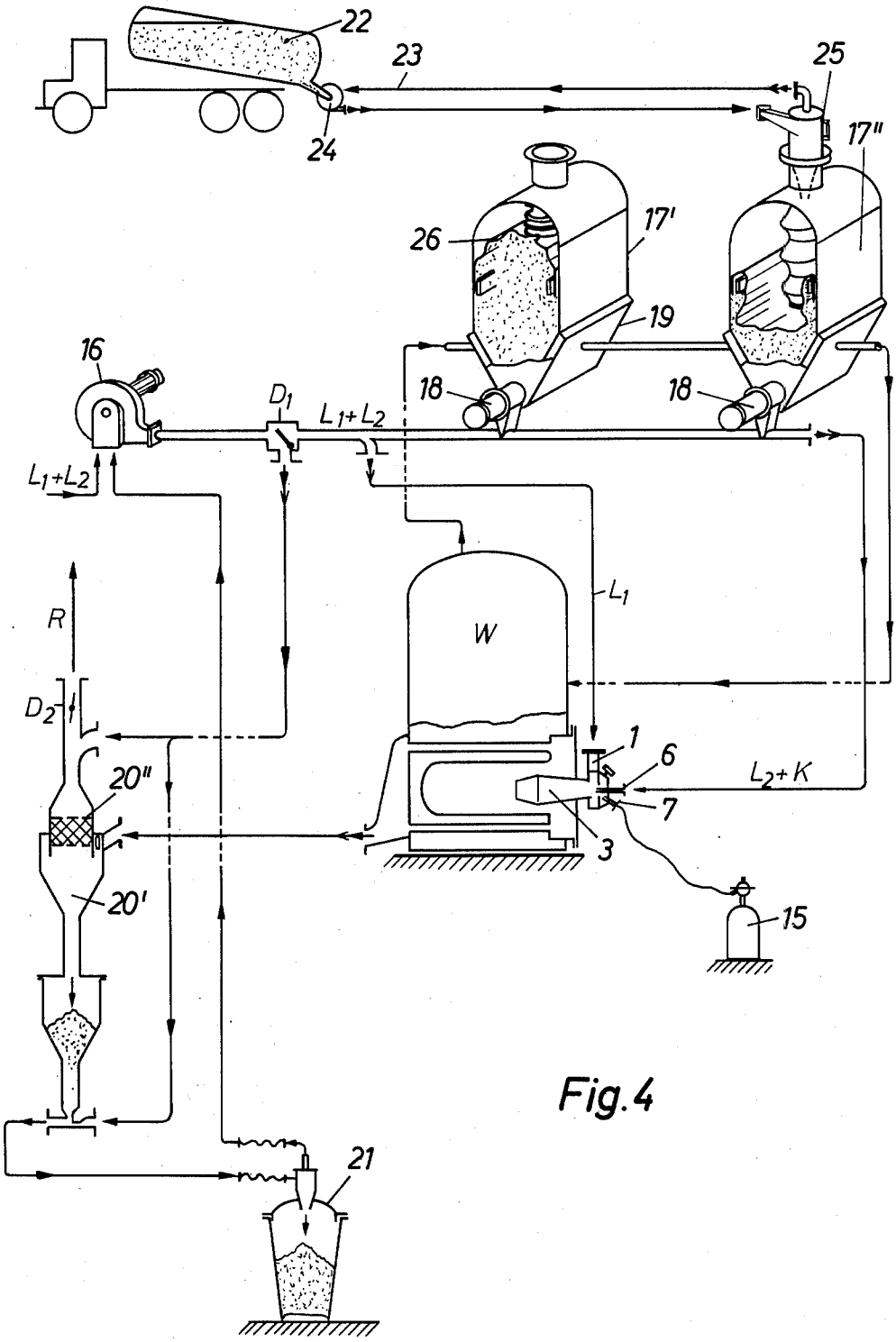
FIG. 4 shows a schematic flow sheet of an arrangement for the transportation, the loading, the storage and the combustion of pulverized coal in a hot water fire tube boiler.

FIG. 4 shows the complete system of a central heating plant fired by pulverized coal, with a hot-water boiler W, with an example according to the invention of a fire tube with backflow which is closed at the end opposite the burner. The pulverized coal burner has been arranged coaxially to the flame tube, with only a few parts 1,2,6,7, indicated in order to simplify matters, carried by a large flange plate or door, beyond which the interior of the fire tube and, if necessary, the flue passes are accessible. This is the current practice in central heating technology.

An air blower or fan 16 supplies combustion air $L_1$ and carrier air $L_2$ by means of a damper $D_1$, which should be positioned horizontally. The combustion air flow $L_1$ is led into the air intake 1 of the combustor. Carrier air $L_2$ proceeds to the coal tanks 17', 17'', which are displayed in FIG. 4, at different states of fill. The therein contained pulverized coal is calibrated by means of screw conveyors to the carrier air $L_2$. An advantage is to have only one of the coal tanks working, for example, coal tank 17'.

The pulverized coal is carried to the coal burner by carrier air $L_2$ and burnt as shown. The cooled flue gases containing fly ash then go to a dust removal, which is shown in FIG. 4 as a combination of a cyclone 20' and a filter 20", which is connected at the outlet side. The damper $D_2$ should not be positioned upright in order to permit the escape of the dust-free flue gases to the stack. The removed ash is collected in the usual way in a container situated below the cyclone 20.

It is current practice in central heating technology to use ON/OFF burner control, in order to adapt it to the changing heat requirements. According to the invention, one takes advantage of this for the cleaning of the filter and the removal of the separated ashes. For that purpose the damper blade $D_1$ is set upright and the damper blade $D_2$ is set horizontally for a short time. Thereby the filter 20" is cleaned by the airflow. At the same time the ash which is deposited in the collecting chamber underneath the cyclone 20 is led into an ash bin 21 with a cyclone on its top according to FIG. 4. The air, which has only been partially freed of dust in this relatively simple cyclone, is carried back to the fan and is so circulated a few times, until all the ashes have been removed to the ash bin and the circulating air is sufficiently cleaned. The whole process only takes a few minutes. After that the plant is ready for the next cycle of combustion, whereby the dampers $D_1$ and $D_2$ are returned to their originally described positions.

The pulverized coal can be delivered in a coal tank car according to the invention. It possesses a double bulk hose 23, a dust blower 24 and a small cyclone 25, which is put on the coal tank to be filled, in this case 17". The carrier air for the dust blower 24 is appropriately taken from the coal tank car. The cyclone can easily be applied to different coal tanks. The filling is equally fast as in the case of an oil-fired system.

It could be necessary to keep atmospheric air away from some kinds of coal, in order to prevent oxidation of the coal on the one hand, and on the other hand to prevent condensation from the atmospheric humidity, especially when the tanks are not being used for long periods of time. According to the invention a cover 26 has been provided for this purpose which is made of teflon-asbestos fabric and is connected with the filling device on top of the coal tank by means of a corrugated hose.

FIG. 4 shows a largely filled coal tank 17' with a cover 26 on top of the pulverized coal and a corrugated hose which is almost completely compressed. The contents of the coal tank 17" have been almost completely emptied so that the cover of the coal surface is sagging downwards considerably and the corrugated hose has been stretched almost completely. This cover will usually not be necessary for low reactivity fuel, as for example pulverized coke and anthracite. Those skilled in the art are familiar with the operation of industrial pulverized coal storage bins.

The amount of gas G necessary for ignition can be supplied by gas bottle 15, which may contain propane and whose contents usually suffice for the ignition for several months. Of course the gas can also be taken from a gas-main.

In order to change over to a gas-fired burner, it is only necessary to replace the injection tube 6 with an adequate gas supply pipe. The gases delivered will ignite just as demonstrated previously. Experiments have shown that a low, steady and total combustion is the result, whereby the burner retains its full efficiency. Experiments have shown that in this way town gas, grid gas, propane and similar heating gases commonly on the market can be fired without having to reset the burner.

In one case the injection tube 6 was equipped with a gas tube (not shown), which surrounded it concentrically. Then the burner could be fired in every mixture ratio between 0 and 100% of gas and pulverized coal at the same time, or with only one of the fuels.

If the injection tube 6 is replaced by the conventional oil gun with atomizer nozzle, whereby the nozzle should be situated at the point where we find the end of the injection tube 6 in FIG. 6, the burner then appropriately functions as an oil burner. It is suitable in the present embodiment as a burner for EL-type, domestic fuel heating oil. Spray angles of the nozzle of about 30° are necessary to adapt the oil delivery to the flow of the slender combustor 3. Oil pressures between 15 and 25 atm. have been proved to be especially suitable for the atomization of domestic fuel heating oil. The atomization of domestic fuel heating oil is also possible with compressed air, provided that the spraying angles remain approximately the same.

The necessary pressure of the combustion air results from the pressure drop of combustion air when flowing through the pulverized coal burner according to FIG. 1 plus the pressure drop when flowing through the following boiler, the flue gas passes, the dust removal etc. Pressure drops of 25–30 mm WG have been proven to be sufficient for small burners (boiler capacities of 100,000 to 200,000 Kcal/h) when flowing through the coal burner according to FIG. 1. An increase of burner capacity requires an increase of the necessary pressure drop. The necessary minimum pressure drop for a capacity of 1 million Kcal/h is about 60–80 mm WG. The burners have no capacity limit, because their flow pattern does not depend on the Reynolds number, as long as the reaction velocity suffices, which depends in the case of pulverized coal on the coal particle size; in the case of oil and gas a flame stability reaching into the range of supersonic speed could be observed, but that requires an uneconomical air pressure.

The burner just described in only one example of the invention. The intake spiral 2, for example, can be replaced by aerodynamically equivalent radial blades. The usual conventional means can be used for the transport and storage of the pulverized coal. Thus, it is possible to store in a larger number of tanks according to FIG. 4 as well as storing in one central silo. Moreover the usual methods for maintaining the flowability of the pulverized coal in the silo or the bins are applicable. It is customary to insert mechanical aerating devices into the tanks, inflatable rubber pads on the walls of the bins or on the nozzles, through which compressed air is blown into the tanks. In cases where atmospheric humidity has caused the contents of the bin to agglomerate, it may suffice to heat up the lower part of the bin to a temperature above the condensation temperature. The lower parts of the bins 17', 17" in FIG. 4 have been equipped with a double wall, through which flows hot water from the hot water boiler W.

The burners can also be equipped with the usual dosing, flame control and ignition devices. All relevant ash removal procedures are adequate for the flue gas removal behind the boiler, including the flue wash by injection of liquids, especially water. It could also be appropriate with larger systems to use different blowers for the various functions instead of the one blower 16, especially if the system is used continuously.

Neither does it matter whether the burner is situated as shown in a horizontal position or in any other position, as long as the combustion chamber, especially the the shape of the fire tube, has been adjusted in accordance with the known standards of technology. Thus it is inadmissible for example to use a very short, wide firing chamber instead of a slender, long firing chamber where the still burning flame would bounce against the fire tube wall opposite the burner.

It is essential, when designing the coal burner according to FIG. 1, to maintain a well-controlled air flow, which has a smooth flame surface and an exactly defined cold air intake 2, as well as a long and strong back flow along the axis of the combustor 3.

As experiments of the inventor have shown, there exists a peculiar flow effect, which fulfills these demands and which is obtained if a device according to FIG. 1 with certain dimensions is chosen. This flow effect can be slightly strengthened or weakened through slight variations in the dimensions, but changes into a completely different flow pattern or disappears completely if the dimensions of the device according to FIG. 1 fall short of or exceed certain conditions.

The following dimensions obtain the most favorable data for a device which delivers 200,000 to 250,000 Kcal/h, at a pressure drop of 100 mm WG of combustion air, when flowing through the device:

spiral angle $\alpha$ of the intake spiral 2 to the circumferential direction: 7°–11° axial length $b$ of the intake spiral 2: $b = 85$ mm intake diameter of the intake spiral 2 into the combustor 3: $d = 145$ mm $\phi$ axial length of the combustor 3: L = 560 mm largest diameter of the combuster 3: D = 290 mm $\phi$ diameter of the injection opening 11 $d_s = 35$–40 mm inner diameter of the air intake 1: $d_L$ = about 300 mm $\phi$.

Such a device really does produce a flame as illustrated in FIG. 1. The flame surface is smooth and the stagnation point is distinctly visible. The thickness of the cold air zone Z between the flame surface and the walls of the combustor 3 averages about 15 mm. After removing the acceleration nozzle 4, it is possible to see through the cold air zone Z from the outside as far as the bottom of the intake spiral 2 and to discern it distinctly. This special control of flow and flame yields the best requisites for carrying out the method according to the invention.

It has also been proven to be profitable to make the outlet diameter of the acceleration nozzle 4 almost the same as the intake diameter of the combustor 3.

The measurements can be changed slightly, whereby one changes the pressure drop and the thickness of the cold air zone Z accordingly.

A diminution of the intake diameter $d$ or of the spiral width $b$ intensifies the rotation of the combustion air and herewith its underpressure as well as the momentum of the backflow along the axis of the combustor 3. The thickness of the cold air zone Z decreases proportionately. Experiments have shown that the factors of decrease of the intake diameter $d$ or of the intake width $b$ or the sum of the two can vary by a ratio of up to about 1.60. The thickness of the cold air zone Z on the outlet diameter D of the combustor 3 becomes so slight that it is not distinctly measurable any more. The temperature of the walls of the combustor 3 and of the acceleration nozzle 4 increases accordingly and the cooling effect becomes accordingly small. Here lies the limit of this design.

An increase of the intake diameter $d$ and of the intake width $b$ by a total of 1.30 is possible; though it is true that the thickness of the cold air zone Z and thereby the amount of air that cannot be mixed with the combustion gases becomes so large that it leads to the appearance of unburnt constituents. Besides the backflow along the axis line, the flame stability diminshes distinctly.

A variation of the spiral angle does not have a measurable effect in the indicated field, which is contrary to current conceptions. Only the pressure drops diminish with an increase in the spiral angle. If a spiral angle of about 20° is exceeded, which can be obtained by using rotatable radial blades, the whole flow pattern changes abruptly and audibly. The high-frequency hissing sound of the flame changes over to a low-frequency muffled rumbling; the flame is not controlled and disciplined any more, but is made up — even though a certain backflow can still be observed — of undefinable, ring-like rotational formations. Flame stability and combustion are poor and the pressure drop of the system drops to a fraction of the original values. When diminishing the spiral angle, a visible and audible reverse transition is obtained.

As the pattern flow is not dependent on the Reynolds number in devices according to FIG. 1, it is very simple to use this in each case for other capacities by increasing or decreasing the device pantographically. The conversion equation is simple, because the charges are exactly proportional to the cross-sections, that is to say to the square of the dimensions.

FIG. 5 shows the design of a combustion chamber according to the invention for a small coal firing with the appropriate ash contents, especially for a hot water boiler in a central heating system. The pulverized coal burner has been drawn in phantom, with its air intake 1 and its combustor 3. The lengthened fire box 30 can have a round or an angular cross-section. The ratio of length to diameter should be greater than 1, preferably 2 – 2.5. It would be appropriate to choose a fire box diameter of 500 – 550 mm for the efficiency of 200,000 to 250,000 Kcal/h, which was stated as example beforehand. If the fire box diameter with the same burner characteristic and efficiency is decreased, the rotational movement of the flue gases in the fire box is obstructed more and more, the smaller the diameter gets, and the necessary cooling of the burning flame gases through intermixed, cooler recirculating gases, does not take place any more. If on the other hand, the diameter of the fire box is increased, having otherwise constant burner characteristic and efficiency, the rotational movement of the flue gases decreases with increasing diameter, the fire box is no longer clean through blowing and the ashes remain behind, which can cause operational difficulties later on. The diameter stated causes adequate cooling off of the flue gases as well as the cleaning of the fire box.

Low ash melting point can cause a pile-up of the ashes in the stagnation point of the flue gases at the end of the fire box opposite the combustor, especially if inadmissibly coarse particles were present in the pulverized coal. According to the invention this difficulty can be solved by inserting a screen 31 of nickel-chromium steel as shown, which is fastened in the usual way, so that it can expand against the bottom of the fire box when heated. Experiments have shown that such a screen stays free of ashes and slag, which could be explained by the changing thermic expansion. Screens of austenitic nickel-chromium cast steel have proved to be the best.

The flue gases leave the fire box according to the invention contrary to the usual versions, at the lower end of the fire box at one end of the two front faces. FIG. 5 shows an arrangement with a flue outlet at the end of the fire box on the side of the burner. The outlet elbow 32 has a shape adapted to the flow, narrowing steadily, in order to avoid a constant acceleration of flow and in order to avoid flow separations until the flue pass 34 is reached.

This is suitably led downward on an incline in order to inhibit ash deposit. The fire box tops 35 and 35' are constructed with a radius of curvature which is as large as possible in order to avoid dead corners and ash deposit. The fire box top 35 on the side of the burner is arched appropriately towards the middle in order to reach the connection adapted to the flow, to the projecting acceleration nozzle 4 of the burner. Hereby dead corners and flow separations are also avoided.

FIG. 6 shows an arrangement according to the invention with an outlet elbow 32' on the end of the fire box 30 opposite the burner. Here also the outlet elbow 32' passes over into the flue pass 34 with acceleration of the flow while avoiding flow separation. On the end facing the burner there is another flue pass 34, which has been shaped correspondingly and passes over into the flue pass 36. A cleaning door 33 has been arranged at the outlet elbow whose form is also adapted to the flow.

Figure 7A:
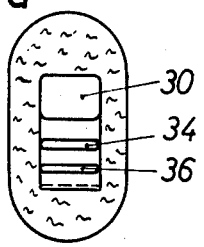

FIG. 7*a* shows a section A – B through FIG. 6. The fire box 30 has an almost rectangular cross-section, whose corners have been rounded off carefully in order to avoid ash deposit. The flue passes 34 and 36, which are also visible in the section are flat ports of almost rectangular cross-section, whose corners are rounded off too, as above. In this case it is possible to remove the flow cross-section along the flow pattern according to the drop in temperature without much additional building cost. Naturally flue passes with a different cross-section, for example fire tubes of the usual design, can be used. But is necessary to bear in mind the need for avoidance of stagnation points and of dead corners.

Figure 7B:
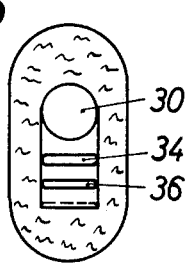

FIG. 7*b* shows the same form of arrangement, only that the fire box has a circular cross-section.

It is advisable to measure the cross-section of the flue passes 34 and 36 by the usual standards of theoretical fluid dynamics so that the dynamic pressure of the respective local flue pass temperature lie between 10 and 25 mm WG. A smaller dynamic pressure can cause the ash to remain there. Moreover the heat transfer coefficient decreases, the smaller the dynamic pressure gets, causing the building cost or the flue gas temperature to rise uneconomically. Dynamic effects are produced above a limit of about 20 to 25 mm WG, which can cause pulsation of the gas mass in the firing chamber, due to reasons unknown. There is an operating range between the two stated limits, in which the flue passes stay clean and on the other hand no dynamic effects are produced.

In the boilers shown in simplified cross-section in FIGS. 5 and 6, the upper part of the boiler is not drawn. An outlet can be adjusted here in the customary way for hot water or steam, or a boiler for the production of water for industrial use.

The design and the structure of the burner, the fire box and the flue passes as described above, according to the invention, can be enlarged or reduced geometrically whereby the dimensions of the fire tube are almost proportional to the dimensions of the burner. The pantographic enlargement and diminution of the dimensions of the burner and the boiler is hereby possible, inasmuch as, because of the strong current momentum and the characteristics of the flow, it refers to flow patterns of free turbulence, which can only be influenced by lifting and tenacity forces in a negligible way. The Reynolds number, the Froude number and similar characteristics can be neglected here. Simple and definite instructions for the design of such facilities have, accordingly, been given. The range of experience comprises fire box diameters of 200 to 1200 mm. The rules of the design inside this range have been proved to be good, with an accuracy of 90%. This is not only of technical importance because there now hereby exist new methods for the calculation of firing facilities, but also of great economical signficance, because it is no longer necessary to develop facilities of different sizes experimentally, on an individual bases. Now it suffices to build one facility of any size, which can be enlarged or reduced pantographically. The physical reason is because the pulverized coal burner according to the invention, besides the characteristics demonstrated at the beginning, is the only burner whose flow pattern is not dependant on the Reynolds number.

The arrangement in FIG. 5 and FIGS. 7*a* and 7*b* shows the most profitable form of design out of the latest state of the art. Of course it can be varied within certain limits, especially when firing coals having ash with a high melting point, which causes no difficulties in the fire box. The burner can then be disposed more or less eccentrically, which causes a onesided rotation of the flue gases in the fire box. This, however, causes a deterioration of the conditions, especially because the flame then approaches the fire box wall and because the distribution of the heat flux density becomes irregular along the fire box walls. The distribution of the flue gases to several parallel cross-sections is also possible, particularly on to a nest of boiler tubes in the known way, but this calls for added building expense in order to be able to inject the flue gases into the tubes for the purpose of avoiding stagnation zones, dead water areas, and other regions in which there is danger of ash deposit.

What is claimed is:

1. Method for the combustion of pulverized coal, which comprises the steps of:
   a. injecting a pulverized coal into a chamber containing atmosphere having the following characteristics:
      i. a static pressure of at least 20 mm WG above the static pressure in the fire tube of a boiler, based on a boiler capacity of 250,000 Kcal/h;
      ii. an $O_2$ content of less than 10% by volume; and
      iii. a temperature sufficient to heat said pulverized coal at a rate of at least 1000° C/sec;
   b. heating the thus injected coal in said chamber at said heating rate to a temperature at least 100° C above the ignition temperature of said coal;
   c. mixing the thus heated pulverized coal with a gaseous mixture consisting essentially of combustion air to cause combustion of said coal;
   d. accelerating a burning flame jet by means of said excess pressure after combustion of at least 30% of the calorific value of said pulverized coal; and
   e. injecting the thus accelerated, still burning flame jet into a gas having a temperature below the ash melting temperature of said pulverized coal.

2. The method according to claim 1 wherein the $O_2$ content is less than 5%.

3. The method according to claim 1 wherein said accelerating occurs after combustion of at least 50% of the calorific value of said coal.

4. The method according to claim 1, wherein the atmosphere into which the accelerated still burning flame jet is injected consists of recirclating cooled flue gases of the flame jet.

5. The method according to claim 4, wherein said recirculating cooled flue gases have been at least partially cooled by convection caused by the injector effect of the flame jet.

6. The method according to claim 1 further including the step of directing a cold gas flow around the flame jet, said cold gas flow cooling the coal particles which are sidewardly flung out of the flame jet below the ash melting temperature.

7. A device for combusting pulverized coal which comprises a combustor having a combustion chamber therein; tangential feeding means having a combustion air flow angle $\alpha$; a feeding tube for said combustion air connected to said feeding means, said combustor widening conically toward the said combustion chamber, said feeding means being positioned at the narrowest cross-section of said combustor an acceleration nozzle opening into said combustion chamber; said device having the following dimensions for a boiler capacity of 200,000 to 250,000 Kcal/h and a pressure drop of combustion air when flowing through the said combustor of 100 mm WG: a combustion air flow angle $\alpha$ of the tangential feeding means of approximately 7°–11°, an axial length of the tangential feeding means of approximately 85 mm, a combustor intake diameter of approximately 145 mm, a combustor outlet diameter of approximately 290 mm a combustor length of approximately 560 mm, a feeding tube for the combustion air with a diameter of approximately 300 mm; said dimensions, with the exception of the combustion air flow angle $\alpha$ varying with the boiler capacity proportionally with the square root of the capacity ratio.

8. Device according to claim 7, wherein the outlet diameter of said acceleration nozzle is approximately equal to the intake diameter of the combustion.

9. Device according to claim 7, including a pulverized coal injection opening internal of the tangential feeding means and having a diameter of substantially 35 to 40 mm.

10. Device according to claim 7, including a coaxial head chamber adjacent to said tangential feeding means, a coal feeding means, a conduit for a partial flow of combustion air, said coal feeding means and said conduit opening into said coaxial head chamber, said chamber including ignition means.

11. Device according to claim 7, wherein the intake diameter of the combustor and the axial length of the tangential feeding means are reduced respectively by factors combinedly equal to up to 1.6.

12. Device according to claim 7 wherein the intake diameter of the combustor and the width of the tangential feeding means are increased respectively by factors combinedly equal to up to 1.3.

13. Device according to claim 7, wherein the combustor is at least partially brick lined.

14. Device according to claim 7, wherein the parts of the combustor and of the accelerator nozzle which are not brick lined are made of heat-resistant steel.

15. Device according to claim 14 wherein said heatresistant steel is nickel-chromium steel.

16. Device according to claim 10 wherein the feeding means for the pulverized coal adjoins injection means for gaseous fuel.

17. Device according to claim 16 wherein the pulverized coal feeding means is surrounded by injection means for gaseous fuel.

18. Device according to claim 7 wherein the feeding means for pulverized coal is a blow-pipe.

19. Device according to claim 18 wherein the blowpipe is detachable for exchange purposes.

20. Device according to claim 7 wherein the combustor fires centrally from one end thereof into an extended fire tube, whereby the ratio of the length to the diameter of the fire tube is larger than 1.5.

21. Device according to claim 20 wherein said ratio of length to diameter of the fire tube is approximately 2.5.

22. Device according to claim 20 wherein a screen of heat-resistant material is fixed to an end of the fire tube, said end being situated opposite the combustor, which screen can expand opposite the wall of the boiler at a rate proportional to its heating.

23. Device according to claim 22 wherein the screen is made of nickel-chromium cast steel.

24. Device according to claim 20, wherein the fire tube has curved end surfaces designed with maximum allowable radii of curvature.

25. Device according to claim 20, wherein the said fire tube has an acceleration nozzle projecting thereinto.

26. Device according to claim 25 wherein the curvature of the fire tube end near the combustor is such that its contour passes over to the acceleration nozzle on the combustor without any flow obstacles.

27. Device according to claim 20 including a at least one flue on the underside and at the end of the fire tube, which flue is connected to an elbow having a diminishing diameter.

28. Device according to claim 27, including a cleaning door on the elbow under the combustor, the inner shape of said door being conforming to the shape of the elbow.

29. Device according to claim 28, wherein the flues connected to each end of the elbow are inclined downwards.

30. Device according to claim 29, wherein the said flues have a diminishing diameter.

31. Device according to claim 29 wherein the flues have a flat, essentially rectangular cross-section.

32. Device according to claim 27 wherein the local velocity head of the flue gases is between 10 and 25 mm WG.

33. Device according to claim 32 wherein said local velocity head is between 15 and 20 mm WG.

34. Device according to claim 27 wherein the diameter of the fire tube is approximately 500 – 550 mm for a boiler capacity of 200,000 – 250,000 Kcal/h, said diameter varying proportionally to the dimensions of the combustor.

35. Device according to claim 7, wherein the pulverized coal is conveyed to the said burner from tanks having a flexible cover for protecting the coal from the atmosphere.

36. A device for combusting pulverized coal which comprises: a combustor; tangential feeding means having a combustion air flow angle $\alpha$; a feeding tube for said combustion air connected to said feeding means, said combustor widening conically away from said feeding means, said feeding means being positioned at the narrowest cross-section of said combustor; an acceleration nozzle connected to the largest cross-section of the said combustor; said device having the following dimensions for a boiler capacity of 200,000 to 250,000 Kcal/h and a pressure drop of combustion air when flowing through the combustor of 100 mm of water; a combustion air flow angle of the tangential feeding means of approximately 7°–11°, an axial length of the tangential feeding means of approximately 85 mm, a combustor outlet diameter of approximately 145 mm, a combustor intake diameter of approximately 290 mm, a combustor length of approximately 560 mm, and a diameter of said feeding tube for the combustion air of approximately 300 mm.

* * * * *